US011087693B2

(12) United States Patent
Yin

(10) Patent No.: US 11,087,693 B2
(45) Date of Patent: Aug. 10, 2021

(54) PIXEL CIRCUIT, METHOD OF DRIVING PIXEL CIRCUIT, DISPLAY PANEL AND DISPLAY DEVICE

(71) Applicant: BOE TECHNOLOGY GROUP CO., LTD., Beijing (CN)

(72) Inventor: Xinshe Yin, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/621,137

(22) PCT Filed: Apr. 24, 2019

(86) PCT No.: PCT/CN2019/084015
§ 371 (c)(1),
(2) Date: Dec. 10, 2019

(87) PCT Pub. No.: WO2019/206164
PCT Pub. Date: Oct. 31, 2019

(65) Prior Publication Data

US 2020/0135118 A1 Apr. 30, 2020

(30) Foreign Application Priority Data

Apr. 28, 2018 (CN) ..... 201810404476.X

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/0248* (2013.01)

(58) Field of Classification Search
CPC ..... G09G 3/3291; G09G 3/3266
(Continued)

(56) References Cited

U.S. PATENT DOCUMENTS

2006/0170628 A1 8/2006 Yamashita et al.
2009/0309503 A1 12/2009 Kim
(Continued)

FOREIGN PATENT DOCUMENTS

CN 1705001 A 12/2005
CN 1815538 A 8/2006
(Continued)

OTHER PUBLICATIONS

Office Action of CN201810404476.X and English translation, dated Jun. 3, 2019, 16 pages.
(Continued)

*Primary Examiner* — Prabodh M Dharia
(74) *Attorney, Agent, or Firm* — Muncy, Geissler, Olds & Lowe, P.C.

(57) ABSTRACT

A pixel circuit, a driving method of the pixel circuit, a display panel and a display device are provided. The pixel circuit includes: a resetting sub-circuit, a charging sub-circuit, a driving sub-circuit, a light-emitting sub-circuit, a first capacitor and a second capacitor. The light-emitting sub-circuit is connected to a first node and a first voltage input end. Two ends of the first capacitor are respectively connected to the first node and the first voltage input end. Two ends of the second capacitor are respectively connected to the first node and a second node. The resetting sub-circuit is connected to the first node, a resetting signal input end and a third control signal input end. The charging sub-circuit is connected to the second node, a scanning signal input end, a data signal input end and a first control signal input end. The driving sub-circuit is connected to the first node, the second node, a second control signal input end and a second voltage input end.

10 Claims, 8 Drawing Sheets

(58) Field of Classification Search
USPC ..... 345/76, 173
See application file for complete search history.

(56) References Cited

U.S. PATENT DOCUMENTS

| | | | | |
|---|---|---|---|---|
| 2014/0292736 | A1 | 10/2014 | Tseng et al. | |
| 2015/0356919 | A1 | 12/2015 | Wang et al. | |
| 2016/0171930 | A1 | 6/2016 | Song et al. | |
| 2016/0204166 | A1* | 7/2016 | Yang | G06F 3/044 345/173 |
| 2016/0240139 | A1* | 8/2016 | Yang | G09G 3/32 |
| 2016/0358550 | A1* | 12/2016 | Qing | G09G 3/3266 |
| 2017/0039948 | A1 | 2/2017 | Xu et al. | |
| 2017/0140707 | A1 | 5/2017 | Xu et al. | |
| 2017/0200414 | A1* | 7/2017 | Li | G09G 3/3233 |
| 2018/0197462 | A1 | 7/2018 | Nagayama et al. | |
| 2018/0322829 | A1* | 11/2018 | Xie | G09G 3/3233 |
| 2018/0357963 | A1* | 12/2018 | Gai | G09G 3/3233 |
| 2019/0304368 | A1 | 10/2019 | Yang | |
| 2019/0325826 | A1* | 10/2019 | Yang | G09G 3/3291 |
| 2020/0135118 | A1 | 4/2020 | Yin | |

FOREIGN PATENT DOCUMENTS

| | | | | | |
|---|---|---|---|---|---|
| CN | 101609840 | A | | 12/2009 | |
| CN | 104050916 | A | | 9/2014 | |
| CN | 104700783 | A | | 6/2015 | |
| CN | 104715726 | A | | 6/2015 | |
| CN | 104778925 | A | | 7/2015 | |
| CN | 107393475 | A | * | 11/2017 | G09G 3/3233 |
| CN | 107393475 | A | | 11/2017 | |
| CN | 1073933475 | A | * | 11/2017 | G09G 3/3233 |
| CN | 108288453 | A | | 7/2018 | |

OTHER PUBLICATIONS

International Search Report of PCT/CN2019/084015 and English translation, dated Jul. 24, 2019, 15 pages.

* cited by examiner

PIXEL CIRCUIT, METHOD OF DRIVING PIXEL CIRCUIT, DISPLAY PANEL AND DISPLAY DEVICE

CROSS-REFERENCE TO RELATED APPLICATIONS

This application is the U.S. national phase of PCT Application PCT/CN2019/084015 filed on Apr. 24, 2019, which claims a priority to Chinese Patent Application No. 201810404476.X filed on Apr. 28, 2018, the disclosures of which are incorporated in their entirety by reference herein.

TECHNICAL FIELD

The present disclosure relates to the field of display technology, in particular to a pixel circuit, a method of driving the pixel circuit, a display panel and a display device.

BACKGROUND

A driving principle of an OLED (Organic Light-Emitting Diode) pixel circuit is that: an OLED is connected to an electrode of a driving transistor, another electrode of the driving transistor is connected to a driving voltage, and a gate of the driving transistor is connected to a data line through a switching transistor. A driving current inputted to the OLED of the driving transistor has a quadratic relationship with a threshold voltage and the driving voltage of the driving transistor. An input voltage is converted into a current by a driving transistor to drive the OLED to emit light. Depending on a transfer curve of the driving transistor, a magnitude of the driving current is related to the threshold voltage of the driving current. In the case that there is a large difference between the threshold voltages of the driving transistors of two adjacent pixels, such as the difference exceeding 0.1 V, the driving current is deviated, resulting in a difference of brightness between the two pixels. In the case that eyes of an observer can feel the difference of brightness, an hourglass phenomenon appears on a display image. At the same time, since the driving circuit of the OLED pixel is a current device and there is a resistor on a power supply lead, the brightness of the pixel can be changed along a length of the power supply lead, that is, a power voltage drop phenomenon occurs.

SUMMARY

A pixel circuit, a driving method of the pixel circuit, a display panel and a display device are provided by the present disclosure.

The pixel circuit in some embodiments of the present disclosure includes a resetting sub-circuit, a charging sub-circuit, a driving sub-circuit, a light-emitting sub-circuit, a first capacitor and a second capacitor;

the light-emitting sub-circuit is connected to a first node and a first voltage input end;

two ends of the first capacitor are respectively connected to the first node and the first voltage input end;

two ends of the second capacitor are respectively connected to the first node and a second node;

the resetting sub-circuit is connected to the first node, a resetting signal input end and a third control signal input end, and is configured to set a voltage of the first node according to a resetting signal;

the charging sub-circuit is connected to the second node, a scanning signal input end, a data signal input end and a first control signal input end, and is configured to charge the first capacitor and the second capacitor according to a scanning signal, a data signal and a first control signal to adjust a voltage of the first node and store display data; and the driving sub-circuit is connected to the first node, the second node, a second control signal input end and a second voltage input end, and is configured to input a driving current to the light-emitting sub-circuit according to a second control signal to drive the light-emitting sub-circuit to emit light.

In some embodiments, the resetting sub-circuit includes a first transistor, and a control electrode of the first transistor is connected to the resetting signal input end, a first electrode of the first transistor is connected to the first node, and a second electrode of the first transistor is connected to the third control signal input end.

In some embodiments, the charging sub-circuit includes a second transistor and a third transistor;

a control electrode of the second transistor is connected to the scanning signal input end, a first electrode of the second transistor is connected to the data signal input end, and a second electrode of the second transistor is connected to the second node; and a control electrode of the third transistor is connected to the first control signal input end, a first electrode of the third transistor is connected to the data signal input end, and a second electrode of the third transistor is connected to the second node.

In some embodiments, the driving sub-circuit includes a fourth transistor and a fifth transistor;

a control electrode of the fourth transistor is connected to the second node, a first electrode of the fourth transistor is connected to a second electrode of the fifth transistor, and a second electrode of the fourth transistor is connected to the first node; and a control electrode of the fifth transistor is connected to the second control signal input end, a first electrode of the fifth transistor is connected to the second voltage input end, and the second electrode of the fifth transistor is connected to the first electrode of the fourth transistor.

In some embodiments, the transistors are all NMOS transistors.

A display panel in some embodiments of the present disclosure includes the pixel circuit as described above.

A display device in some embodiments of the present disclosure includes a driving chip and the display panel as described above. The driving chip is connected to the pixel circuit in the display panel; and the pixel circuit drives the display panel to display an image according to an input signal of the driving chip.

A driving method is provided in some embodiments of the present disclosure to drive the pixel circuit as described above. The driving method includes:

in a resetting stage, inputting a high level signal to the resetting signal input end, and inputting a low level signal the first control signal input end, wherein the resetting sub-circuit sets the voltage of the first node to a first voltage according to the high level signal;

in a threshold voltage establishment stage, inputting the high level signal to the first control signal input end and the second control signal input end, and inputting the low level signal to the scanning signal input end and the resetting signal input end, wherein the charging sub-circuit sets a voltage of the second node, and adjusts the voltage of the first node to a second voltage;

in a data scanning input stage, inputting the high level signal to the scanning signal input end, and inputting the low level signal to the first control signal input end, the second control signal input end and the resetting signal input end, wherein the charging sub-circuit charges the first capacitor and the second capacitor to store the display data inputted by the data signal input end;

in a light-emitting stage, inputting the high level signal to the second control signal input end, and inputting the low level signal to the first control signal input end, the scanning signal input end and the resetting signal input end, wherein the driving sub-circuit inputs the driving current to the light-emitting sub-circuit to drive the light-emitting sub-circuit to emit light.

In some embodiments, the voltage of the first node is set and adjusted in a displaying filed blanking stage.

In some embodiments, a voltage of the third control signal input end is smaller than a sum of a voltage of the first voltage input end and a turn-on voltage of the light-emitting sub-circuit when the voltage of the first node is set; and a reference voltage inputted by the data signal input end is greater than a sum of the voltage of the third control signal input end and a threshold voltage of a fourth transistor when the voltage of the second node is set.

In the embodiments of the present disclosure, the pixel circuit includes the resetting sub-circuit, the charging sub-circuit, the driving sub-circuit, the light-emitting sub-circuit, the first capacitor and the second capacitor. Since the driving current is only related to the reference voltage and the display data inputted by the data signal input end when the light-emitting sub-circuit in the pixel circuit emits light, thereby avoiding uneven brightness of pixels and eliminating an adverse effect of a power line voltage drop to a display brightness.

DETAILED DESCRIPTION

In order to make the objects, technical features and advantages of the present disclosure clearer and easier to be understood, the embodiments of the present disclosure will be clearly and completely described below in conjunction with the drawings of the embodiments of the present disclosure.

Figure 1:
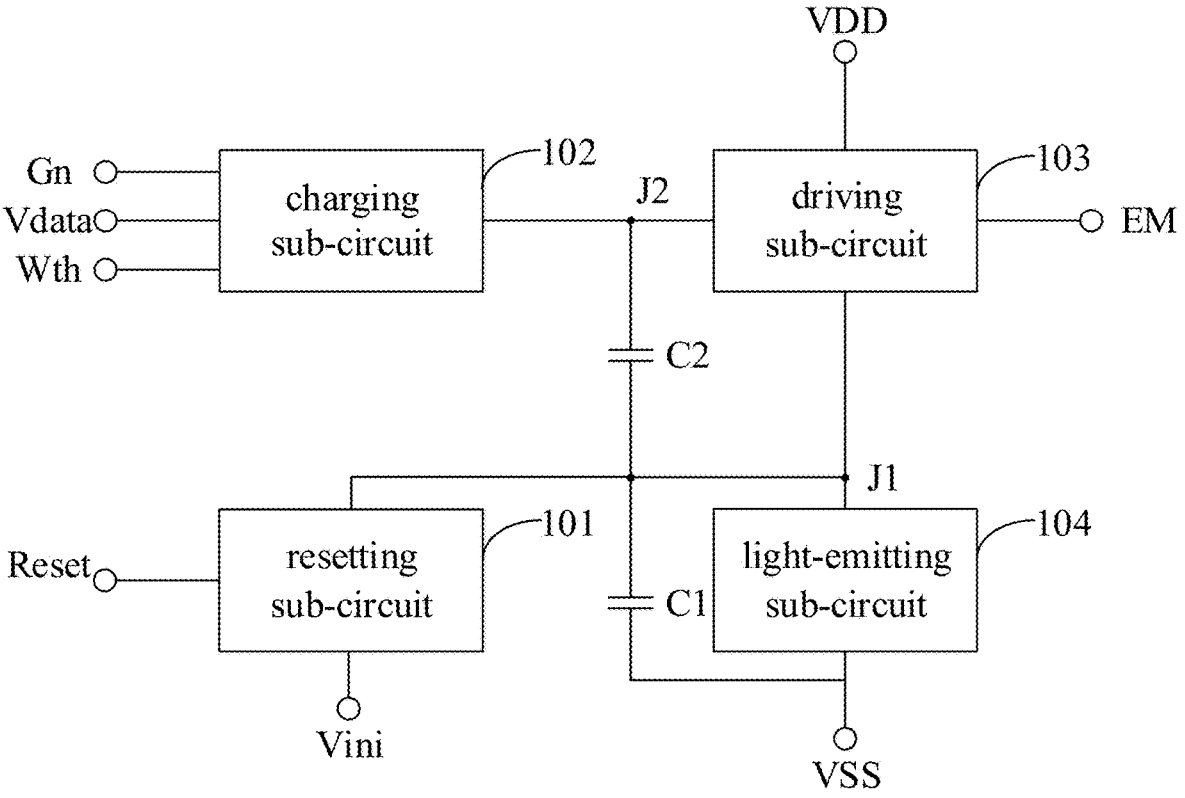
FIG. 1 is a schematic view of a pixel circuit in some embodiments of the present disclosure.

FIG. 1 shows a schematic view of a pixel circuit in some embodiments of the present disclosure. The pixel circuit includes: a resetting sub-circuit 101, a charging sub-circuit 102, a driving sub-circuit 103, a light-emitting sub-circuit 104, a first capacitor C1 and a second capacitor C2.

The light-emitting sub-circuit 104 is respectively connected to a first node J1 and a first voltage input end VSS. Two ends of the first capacitor C1 are respectively connected to the first node J1 and the first voltage input end VSS. Two ends of the second capacitor C2 are respectively connected to the first node J1 and a second node J2. The resetting sub-circuit 101 is respectively connected to the first node J1, a resetting signal input end Reset and a third control signal input end Vini, and is configured to set a voltage of the first node J1 according to a resetting signal. The charging sub-circuit 102 is respectively connected to the second node J2, a scanning signal input end Gn, a data signal input end Vdata and a first control signal input end Wth, and is configured to charge the first capacitor C1 and the second capacitor C2 according to a scanning signal, a data signal and a first control signal to adjust a voltage of the first node J1 and store display data. The driving sub-circuit 103 is respectively connected to the first node J1, the second node J2, a second control signal input end EM and a second voltage input end VDD, and is configured to input a driving current to the light-emitting sub-circuit 104 according to a second control signal to drive the light-emitting sub-circuit 104 to emit light.

In some embodiments, the light-emitting sub-circuit 104 may be an OLED transistor.

Figure 2:
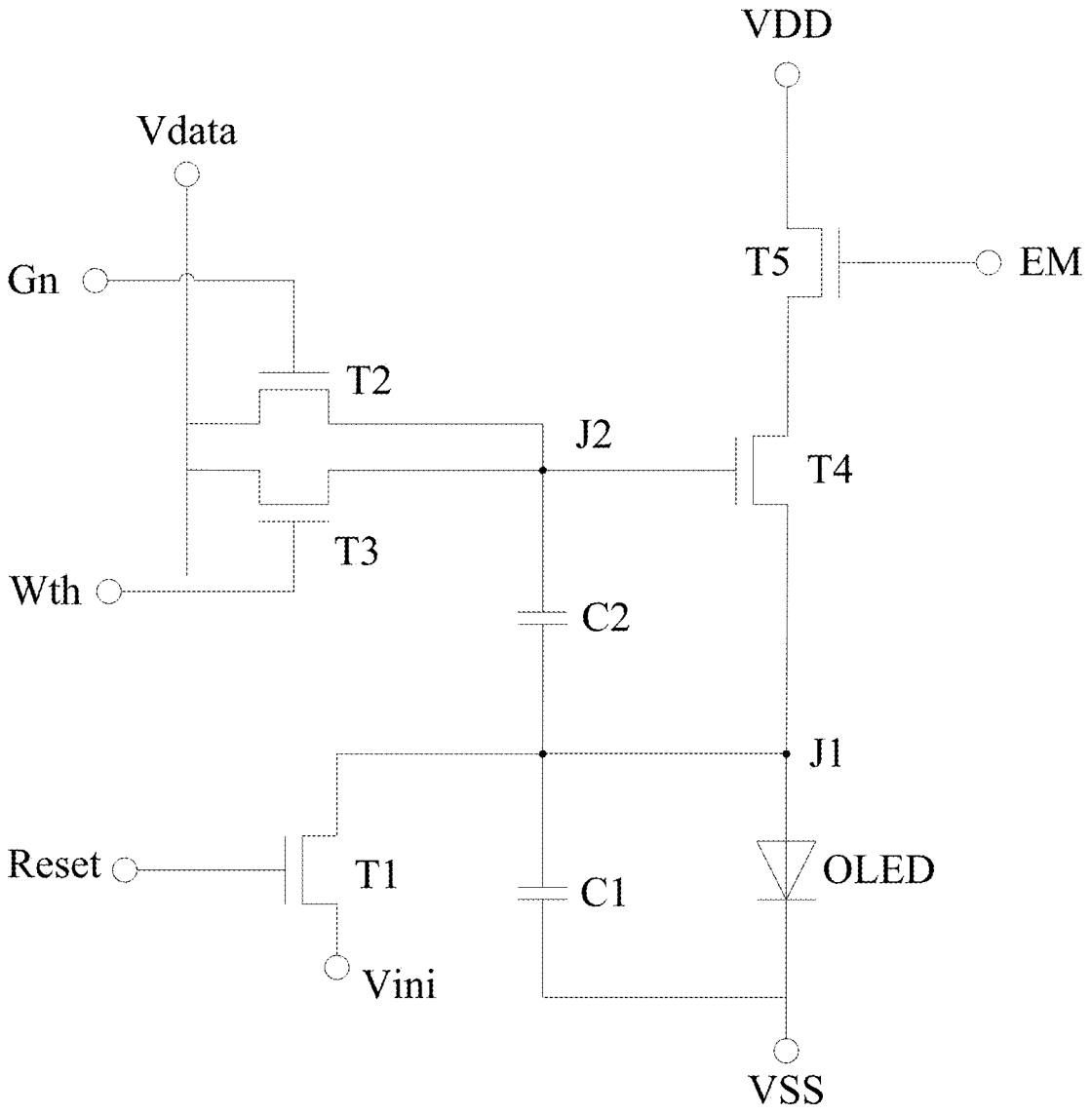
FIG. 2 is a schematic view of a pixel circuit in some embodiments of the present disclosure.

FIG. 2 shows a schematic view of the pixel circuit in some embodiments of the present disclosure.

The resetting sub-circuit 101 includes a first transistor T1, and a control electrode of the first transistor T1 is connected to the resetting signal input end Reset, a first electrode of the first transistor T1 is connected to the first node J1, and a second electrode of the first transistor T1 is connected to the third control signal input end Vini.

The charging sub-circuit 102 includes a second transistor T2 and a third transistor T3. A control electrode of the second transistor T2 is connected to the scanning signal input end Gn, a first electrode of the second transistor T2 is connected to the data signal input end Vdata, and a second electrode of the second transistor T2 is connected to the second node J2. A control electrode of the third transistor T3 is connected to the first control signal input end Wth, a first electrode of the third transistor T3 is connected to the data signal input end Vdata, and a second electrode of the third transistor T3 is connected to the second node J2.

The driving sub-circuit 103 includes a fourth transistor T4 and a fifth transistor T5. A control electrode of the fourth transistor T4 is connected to the second node J2, a first electrode of the fourth transistor T4 is connected to a second electrode of the fifth transistor T5, and a second electrode of the fourth transistor T4 is connected to the first node J1. A control electrode of the fifth transistor T5 is connected to the second control signal input end EM, a first electrode of the fifth transistor T5 is connected to the second voltage input end VDD, and the second electrode of the fifth transistor T5 is connected to the first electrode of the fourth transistor T4.

In some embodiments of the present disclosure, the transistors are all NMOS transistors.

The pixel circuit is formed by a PMOS transistor. In order to make a driving transistor turn on for a long time, a negative voltage needs to be applied to the PMOS transistor, so that a large number of holes are accumulated at an interface between a semiconductor and an oxide layer, and the holes are tunneled into traps at an interface of the oxide layer. With more and more holes tunneled into the traps in the oxide layer, a threshold voltage of the driving transistor may drift. Since a mobility of the holes is low, the holes falling into the traps are difficult to be pulled out of the traps even a positive voltage is applied to the holes. In some embodiments of the present disclosure, the NMOS transistor is applied. Since carriers are electrons, the electrons falling into the trap are relatively easily pulled out of the traps, which is advantageous for recovery of the threshold voltage.

A display panel provided in some embodiments of the present disclosure includes the pixel circuit as described above.

In some embodiments, the display panel is formed by an array of the pixel circuits.

A display device provided in some embodiments of the present disclosure includes a driving chip and the display panel as described above. The driving chip is connected to the pixel circuit in the display panel; and the pixel circuit drives the display panel to display an image according to an input signal of the driving chip.

A driving method is provided in some embodiments of the present disclosure to drive the pixel circuit as described above.

Figure 3:
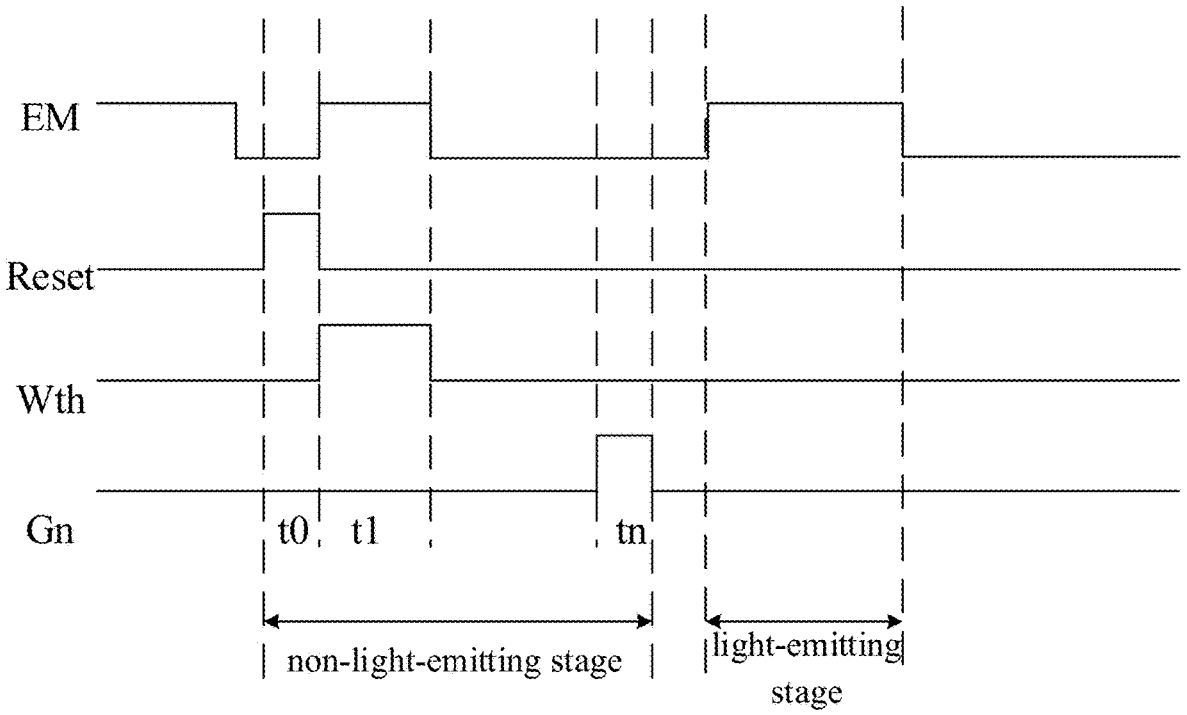
FIG. 3 is a schematic view of a signal waveform in some embodiments of the present disclosure.

The light-emitting sub-circuit in the pixel circuit emits the light in a period of a display frame, and the period of one frame includes a non-light-emitting stage and a light-emitting stage. FIG. 3 shows a schematic view of a signal waveform in some embodiments of the present disclosure. In the non-light-emitting stage, a t0 stage (i.e. a resetting stage), a high level signal is inputted to the resetting signal input end Reset, and a low level signal is inputted to the first control signal input end Wth, the second control signal input end EM and the scanning signal input end Gn. The resetting sub-circuit 101 sets the voltage of the first node J1 to be a first voltage V1 according to the high level signal.

Figure 5:
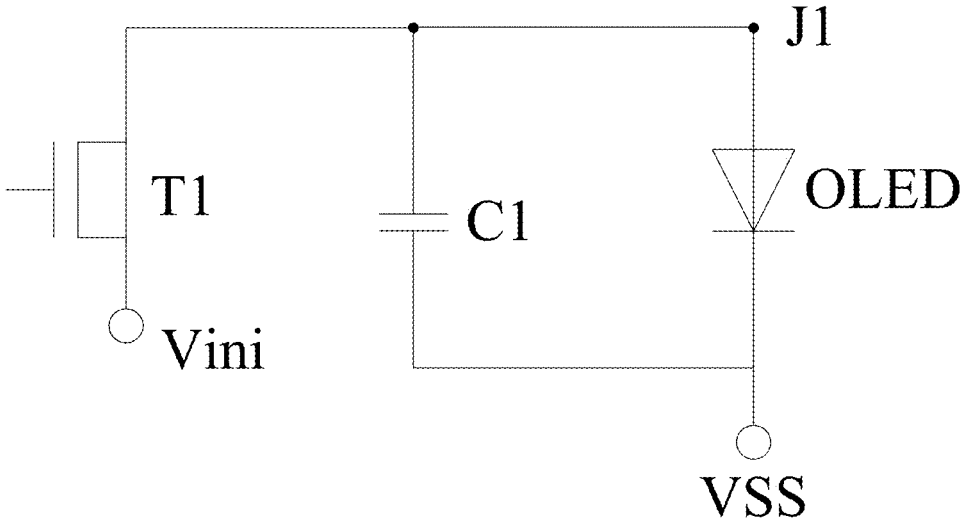
FIG. 5 is an equivalent diagram of a pixel circuit in some embodiments of the present disclosure.

In the t0 stage, the high level signal is inputted to the resetting signal input end Reset, and the low level signal is inputted to the first control signal input end Wth, the second control signal input end EM and the scanning signal input end Gn. The first transistor T1 is turned on, and the second transistor T2, the third transistor T3 and the fifth transistor T5 are all turned off. FIG. 5 shows an equivalent diagram of the pixel circuit. The first capacitor C1 is charged by a voltage of the third control signal input end Vini, and the voltage of the first node J1 is set to be the first voltage, and the first voltage is the voltage of the third control signal input end Vini. At this time, the voltage of the third control signal input end Vini is smaller than a sum of the voltage of the first voltage input end VSS and a turn-on voltage of the light-emitting sub-circuit 104, so as to ensure that the OLED cannot emit the light in the non-light-emitting stage after the voltage of the third the control signal input end Vini charges the first capacitor C1, thereby improving a contrast ratio of the display panel.

As shown in FIG. 3, in the non-light-emitting stage, a t1 stage (i.e. a Vth establishment stage), the high level signal is inputted to the first control signal input end Wth and the second control signal input end EM, and the low level signal is inputted to the scanning signal input end Gn and the resetting signal input end Reset, the charging sub-circuit 102 sets a voltage of the second node J2, and adjusts the voltage of the first node J1 to a second voltage V2.

Figure 6:
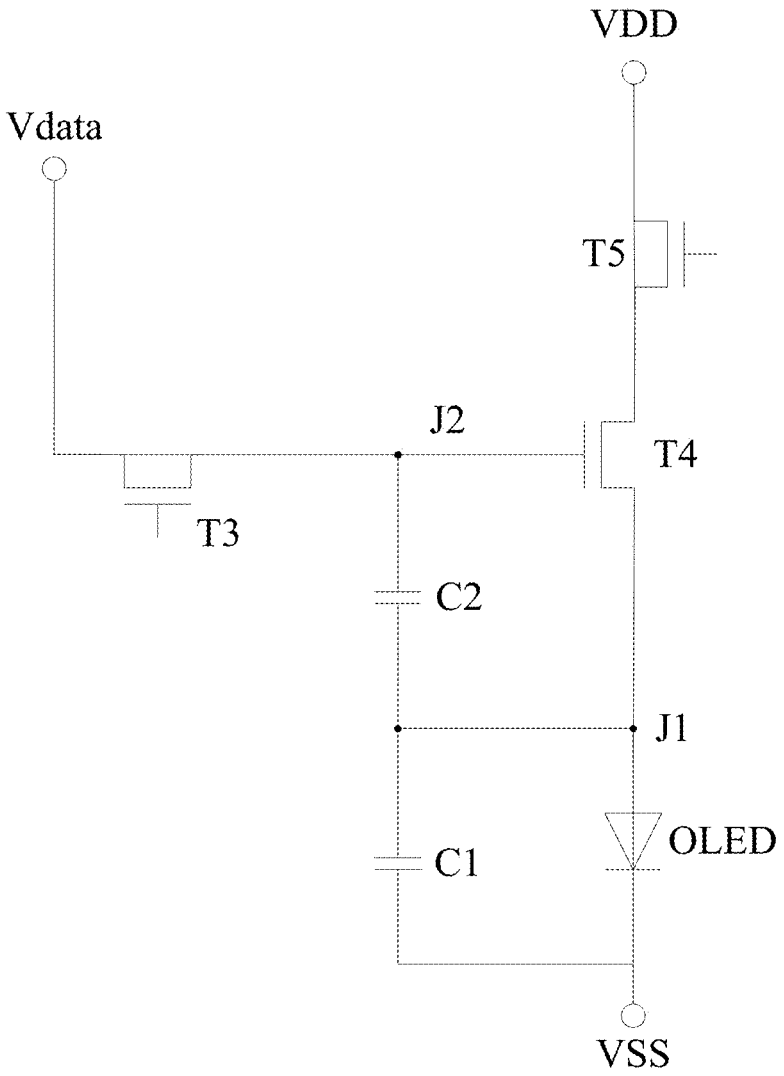
FIG. 6 is an equivalent diagram of a pixel circuit in some embodiments of the present disclosure.

In the t1 stage, the high level signal is inputted to the first control signal input end Wth and the second control signal input end EM, and the low level signal is inputted to the scanning signal input end Gn and the resetting signal input end Reset, the third transistor T3 and the fifth transistor T5 are both turned on, and the first transistor T1 and the second transistor T2 are turned off. FIG. 6 shows an equivalent diagram of the pixel circuit. The data signal input end Vdata inputs a reference voltage Vref and sets the voltage of the second node J2. The reference voltage Vref is greater than a sum of the voltage of the third control signal input end Vini and a threshold voltage Vth of the fourth transistor T4. The fourth transistor T4 is turned on to charge the first capacitor C1, and adjusts the voltage of the first node J1 to the second voltage V2. In the case that the voltage of the first node J1 is raised to Vref−Vth, the fourth transistor T4 is turned off, and the voltage of the second node J2 is equal to Vref, an electric charge of the first node J1 is Q1=C1×(V2−VSS)−C2×Vth=C1×(Vref−Vth−VSS)−C2×Vth.

Setting and adjusting the voltage of the first node J1 as described above is completed in a vertical blank stage of a display. Specifically, after scanning one frame of an image, a scanning point returns from a lower right corner of the image to an upper left corner of the image to start scanning of a new frame, and a returned time interval is the vertical blank (V-Blank) stage.

Figure 4:
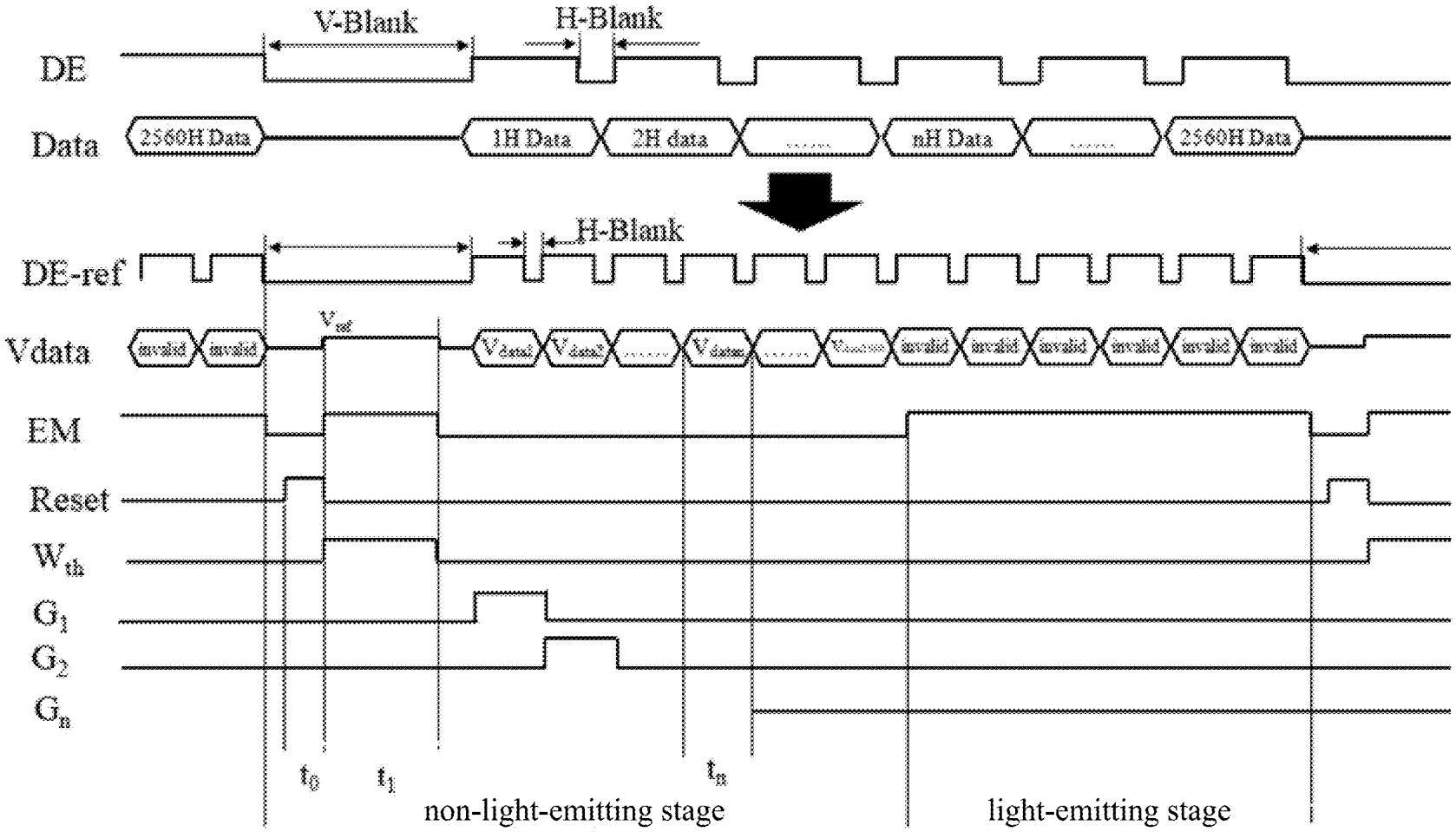
FIG. 4 is a schematic view of a signal waveform in some embodiments of the present disclosure.

FIG. 4 shows a schematic view of a signal waveform in some embodiments of the present disclosure. DE and Data are signals inputted to the driving chip, DE-ref is an internal signal of the driving chip, Vdata, EM, Reset, Wth, G1, . . . Gn are signals inputted to the display panel from the driving chip, and the display panel is formed by the array of the pixel circuits. V-Blank is the vertical blank stage of the display, H-Blank is a horizontal blank stage of the display. The OLEDs on the display panel are reset and Vth established in the vertical blank stage. Before the OLEDs emit the light, the voltage of the first node in each pixel circuit has finished being set and adjusted. In the light-emitting stage, the OLEDs can simultaneously emit the light according to a driving signal to realize an image display. Compared with a technical solution in the related art, that is setting a voltage of a next line after the OLEDs of a previous line emit the light, setting of the voltage of all the OLEDs according to the embodiments of the present disclosure are first completed in the vertical blank stage, which can save scanning time.

As shown in FIG. 3, in the non-light-emitting stage, a tn stage (i.e. a data scanning input stage), the high level signal is inputted to the scanning signal input end Gn, and the low level signal is inputted to the first control signal input end Wth, the second control signal input end EM and the resetting signal input end Reset. The charging sub-circuit 102 charges the first capacitor C1 and the second capacitor C2 to store the display data inputted by the data signal input end Vdata.

Figure 7:
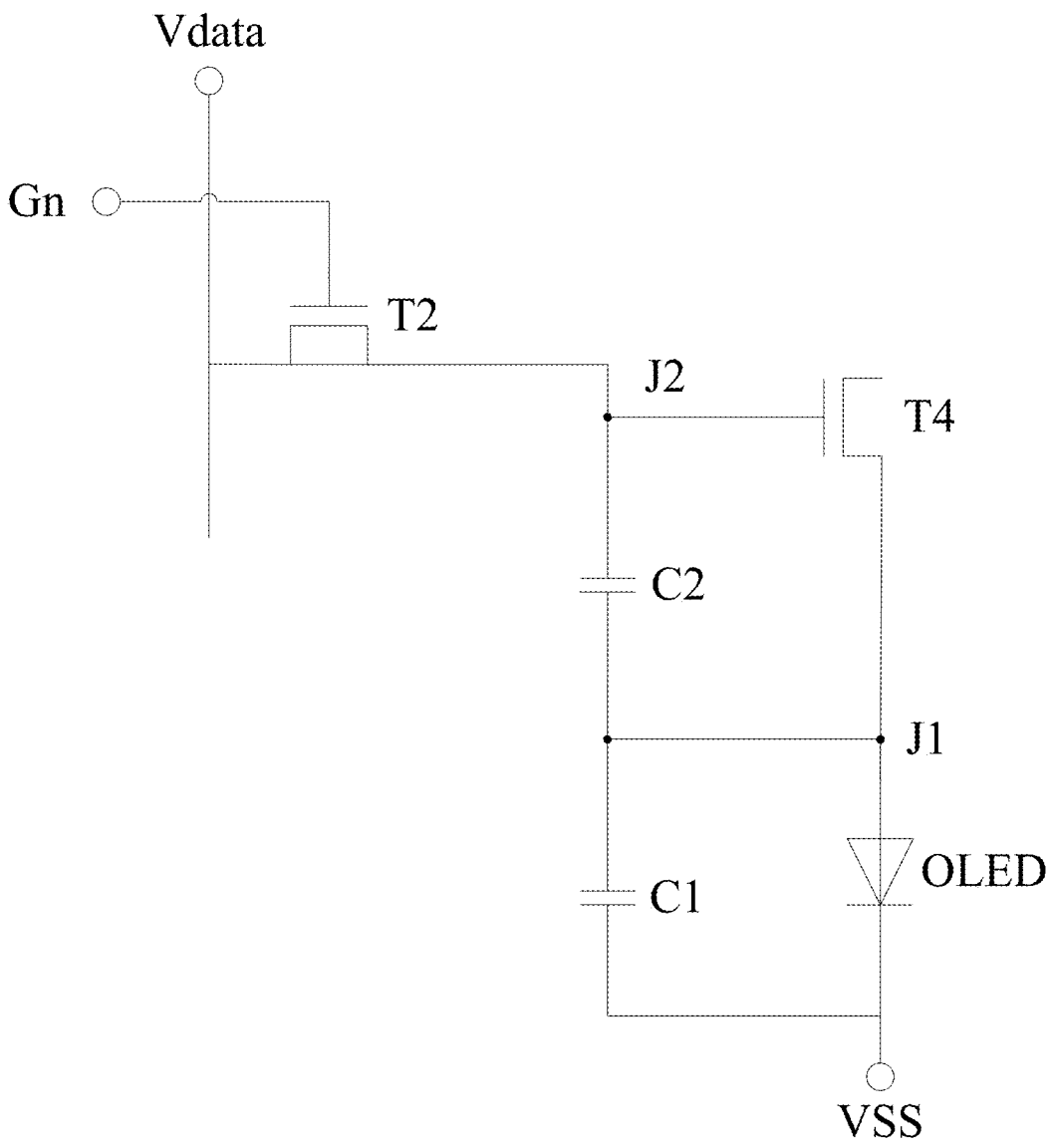
FIG. 7 is an equivalent diagram of a pixel circuit in some embodiments of the present disclosure.

In the tn stage, the high level signal is inputted to the scanning signal input end Gn, and the low level signal is inputted to the first control signal input end Wth, the second control signal input end EM and the resetting signal input end Reset, the second transistor T2 is turned on, the first transistor T1, the third transistor T3 and the fifth transistor T5 are all turned off. FIG. 7 shows an equivalent diagram of the pixel circuit. The data signal input end Vdata inputs display data to charge the first capacitor C1 and the second capacitor C2. Since the first node J1 has no inflow and outflow of electric charge when the display data is inputted, the electric charge Q2 of the first node J1 equal to Q1. At this time, the voltage of the first node J1 is set to V3, thus, $$C1\times(V3-VSS)-C2\times(V\text{data}-V3)=C1\times(V\text{ref}-Vth-VSS)-C2\times Vth,$$

$$(C1+C2)\times V3=C2\times V\text{data}+C1\times V\text{ref}-(C1+C2)\times Vth, \text{ and}$$

$$V3=(C2\times V\text{data}+C1\times V\text{ref})/(C1+C2)-Vth.$$

As shown in FIG. 3, in the light-emitting stage, the high level signal in inputted to the second control signal input end EM, and the low level signal is inputted to the first control signal input end Wth, the scanning signal input end Gn and the resetting signal input end Reset. The driving sub-circuit 103 inputs the driving current to the light-emitting sub-circuit 104 to drive the light-emitting sub-circuit 104 to emit the light.

Figure 8:
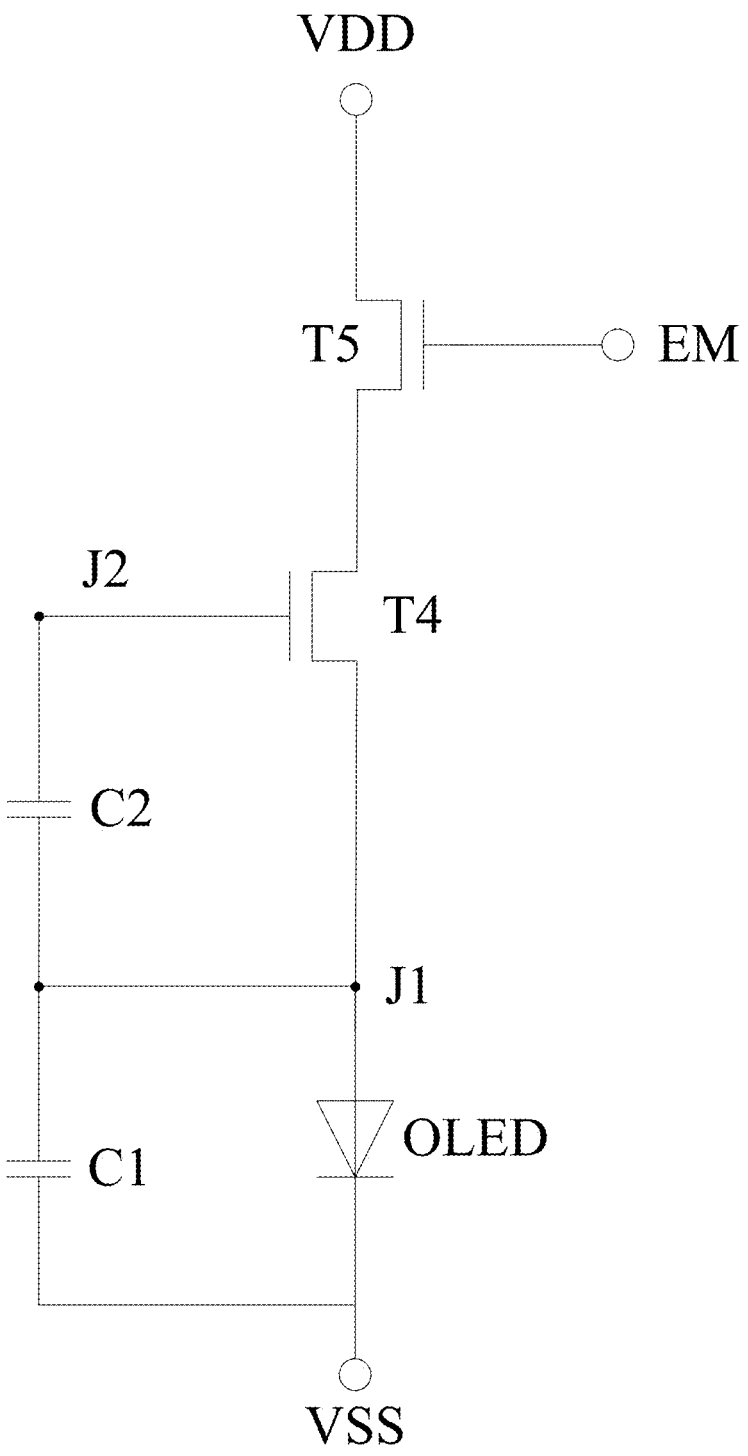
FIG. 8 is an equivalent diagram of a pixel circuit in some embodiments of the present disclosure.

In the light-emitting stage, the high level signal in inputted to the second control signal input end EM, and the low level signal is inputted to the first control signal input end Wth, the scanning signal input end Gn and the resetting signal input end Reset. The fifth transistor T5 is turned on, and the first transistor T1, the second transistor T2 and the third transistor T3 are all turned off. FIG. 8 shows an equivalent diagram of a pixel circuit. The first node J1 outputs the driving current to drive the light-emitting sub-circuit 104 to emit the light. A turn-on voltage of the fourth transistor T4 is VG, thus $$VG = VJ2 - VJ1 =$$

$$VJ2 - V3 = Vdata - (C2 \times Vdata + C1 \times Vref)/(C1 + C2) + Vth =$$

$$C1/(C1 + C2) \times (Vdata - Vref) + Vth$$

The driving current outputted by the fourth transistor T4 is I, thus $$I = (1/2) \times \mu \times COX \times (W/L) \times (VG - Vth)2 =$$

$$\mu COXW[C1(Vdata - Vref)/(C1 + C2)]2/(2L)$$

It can be seen that the driving current I is only related to the display data Vdata and the reference voltage Vref inputted to the data signal input end, and is independent of the driving voltage VDD of the second voltage input end and the threshold voltage Vth of the fourth transistor. Thus, a compensation effect of driving voltage and threshold voltage is achieved, thereby eliminating effects of a hourglass phenomenon and a power voltage drop phenomenon.

In summary, in some embodiments of the present disclosure, the pixel circuit includes the resetting sub-circuit, the charging sub-circuit, the driving sub-circuit, the light-emitting sub-circuit, the first capacitor and the second capacitor. Since in the case that the light-emitting sub-circuit in the pixel circuit emits the light, the driving current is only related to the reference voltage and the display data inputted by the data signal input end, thereby avoiding uneven brightness of pixels and eliminating the adverse effect of a power line voltage drop to a display brightness.

The various embodiments in the present disclosure are described in a progressive manner, and each embodiment focuses on differences from other embodiments, and the same or similar parts between the various embodiments may be referred to each other.

At last, it should be noted that, in the present disclosure, relational terms such as first and second, etc. are merely used to distinguish one entity or operation from another entities or operations, but do not necessarily require or imply any actual relationship or order between the entities or the operations. And the terms "including", "comprising", or any other variant thereof are intended to encompass a non-exclusive inclusion, so that processes, methods, commodities or equipment that include a set of elements include not only those elements, but also other elements which are not explicitly listed, or further include the elements that are inherent to such processes, methods, commodities or equipment. In the case of no more limitations, an element defined by the phrase "comprising a . . . " does not exclude the case that there are another identical elements in the process, the method, the article or the device which includes the above elements.

The pixel circuit, the driving method of the pixel circuit, the display panel and the display device provided by the present disclosure have been described in detail above. The principles and embodiments of the present disclosure have been described herein with specific examples. The descriptions of the above embodiments is only for helping to understand the technical solutions and the core ideas of the present disclosure. In addition, it is apparent to those skilled in the art that, based on the embodiments of the present disclosure, the specific implementation and application scope can be changed. In summary, the content of the present disclosure should not be construed as limiting the present disclosure.

What is claimed is:

1. A pixel circuit, comprising a resetting sub-circuit, a charging sub-circuit, a driving sub-circuit, a light-emitting sub-circuit, a first capacitor and a second capacitor; wherein the light-emitting sub-circuit is connected to a first node and a first voltage input end;

two ends of the first capacitor are respectively connected to the first node and the first voltage input end;

two ends of the second capacitor are respectively connected to the first node and a second node;

the resetting sub-circuit is connected to the first node, a resetting signal input end and a third control signal input end, and is configured to set a voltage of the first node according to a resetting signal;

the charging sub-circuit is connected to the second node, a scanning signal input end, a data signal input end and a first control signal input end, and is configured to charge the first capacitor and the second capacitor according to a scanning signal, a data signal and a first control signal, to adjust a voltage of the first node and store display data; and the driving sub-circuit is connected to the first node, the second node, a second control signal input end and a second voltage input end, and is configured to input a driving current to the light-emitting sub-circuit according to a second control signal, to drive the light-emitting sub-circuit to emit light.

2. The pixel circuit according to claim 1, wherein the resetting sub-circuit comprises a first transistor, and a control electrode of the first transistor is connected to the resetting signal input end, a first electrode of the first transistor is connected to the first node, and a second electrode of the first transistor is connected to the third control signal input end.

3. The pixel circuit according to claim 1, wherein the charging sub-circuit comprises a second transistor and a third transistor;

a control electrode of the second transistor is connected to the scanning signal input end, a first electrode of the second transistor is connected to the data signal input end, and a second electrode of the second transistor is connected to the second node; and a control electrode of the third transistor is connected to the first control signal input end, a first electrode of the third transistor is connected to the data signal input end, and a second electrode of the third transistor is connected to the second node.

4. The pixel circuit according to claim 1, wherein the driving sub-circuit comprises a fourth transistor and a fifth transistor;

a control electrode of the fourth transistor is connected to the second node, a first electrode of the fourth transistor is connected to a second electrode of the fifth transistor, and a second electrode of the fourth transistor is connected to the first node; and a control electrode of the fifth transistor is connected to the second control signal input end, a first electrode of the fifth transistor is connected to the second voltage input end, and the second electrode of the fifth transistor is connected to the first electrode of the fourth transistor.

5. The pixel circuit according to claim 1, wherein the transistors are all NMOS transistors.

6. A display panel comprising the pixel circuit according to claim 1.

7. A display device, comprising a driving chip and the display panel according to claim 6, wherein the driving chip is connected to the pixel circuit in the display panel; and the pixel circuit drives the display panel to display an image according to an input signal of the driving chip.

8. A method of driving a pixel circuit, wherein the pixel circuit comprises a resetting sub-circuit, a charging sub-circuit, a driving sub-circuit, a light-emitting sub-circuit, a first capacitor and a second capacitor;

the light-emitting sub-circuit is connected to a first node and a first voltage input end;

two ends of the first capacitor are respectively connected to the first node and the first voltage input end;

two ends of the second capacitor are respectively connected to the first node and a second node;

the resetting sub-circuit is connected to the first node, a resetting signal input end and a third control signal input end, and is configured to set a voltage of the first node according to a resetting signal;

the charging sub-circuit is connected to the second node, a scanning signal input end, a data signal input end and a first control signal input end, and is configured to charge the first capacitor and the second capacitor according to a scanning signal, a data signal and a first control signal, to adjust the voltage of the first node and store display data; and the driving sub-circuit is connected to the first node, the second node, a second control signal input end and a second voltage input end, and is configured to input a driving current to the light-emitting sub-circuit according to a second control signal, to drive the light-emitting sub-circuit to emit light;

the method comprises:

in a resetting stage, inputting a high level signal to the resetting signal input end, and inputting a low level signal to the first control signal input end, the second control signal input end and the scanning signal input end, setting, by the resetting sub-circuit, the voltage of the first node to a first voltage according to the high level signal;

in a threshold voltage establishment stage, inputting the high level signal to the first control signal input end and the second control signal input end, and inputting the low level signal to the scanning signal input end and the resetting signal input end, setting, by the charging sub-circuit, a voltage of the second node, and adjusting, by the charging sub-circuit, the voltage of the first node to a second voltage;

in a data scanning input stage, inputting the high level signal to the scanning signal input end, and inputting the low level signal to the first control signal input end, the second control signal input end and the resetting signal input end, charging, by the charging sub-circuit, the first capacitor and the second capacitor, to store the display data inputted by the data signal input end;

in a light-emitting stage, inputting the high level signal to the second control signal input end, and inputting the low level signal to the first control signal input end, the scanning signal input end and the resetting signal input end, inputting, by the driving sub-circuit, the driving current to the light-emitting sub-circuit, to drive the light-emitting sub-circuit to emit light.

9. The method according to claim 8, wherein the voltage of the first node is set and adjusted in a vertical blank stage of a display.

10. The method according to claim 8, wherein a voltage of the third control signal input end is smaller than a sum of a voltage of the first voltage input end and a turn-on voltage of the light-emitting sub-circuit when setting the voltage of the first node; and a reference voltage inputted by the data signal input end is greater than a sum of the voltage of the third control signal input end and a threshold voltage of a fourth transistor when setting the voltage of the second node.

* * * * *